US011041688B2

(12) United States Patent
Joplin

(10) Patent No.: US 11,041,688 B2
(45) Date of Patent: Jun. 22, 2021

(54) TUNABLE MUZZLE BRAKE FOR A FIREARM

(71) Applicant: Jered S. Joplin, Jefferson, GA (US)

(72) Inventor: Jered S. Joplin, Jefferson, GA (US)

(73) Assignee: AMERICAN PRECISION ARMS, LLC, Jefferson, GA (US)

( * ) Notice: Subject to any disclaimer, the term of this patent is extended or adjusted under 35 U.S.C. 154(b) by 0 days.

(21) Appl. No.: 16/936,248

(22) Filed: Jul. 22, 2020

(65) Prior Publication Data

US 2021/0088302 A1 Mar. 25, 2021

Related U.S. Application Data

(63) Continuation of application No. 16/533,730, filed on Aug. 6, 2019, now Pat. No. 10,788,283.

(60) Provisional application No. 62/726,361, filed on Sep. 3, 2018.

(51) Int. Cl.
*F41A 21/38* (2006.01)

(52) U.S. Cl.
CPC ..... *F41A 21/38* (2013.01)

(58) Field of Classification Search
CPC ..... F41A 21/34; F41A 21/325; F41A 21/32; F41A 21/28; F41A 21/36; F41A 21/38
USPC ..... 89/14.05, 14.1, 14.3, 14.4; 181/223
See application file for complete search history.

(56) References Cited

U.S. PATENT DOCUMENTS

| | | | | |
|---|---|---|---|---|
| 6,752,062 | B2 | 6/2004 | Vais | |
| 7,032,339 | B1 * | 4/2006 | Bounds | F41A 21/36 42/1.06 |
| 8,042,448 | B1 * | 10/2011 | Sylvester | F41A 21/36 89/14.3 |
| 8,418,803 | B2 * | 4/2013 | Findlay | F41A 21/36 181/223 |
| 9,042,448 | B2 | 5/2015 | Sakazume | |
| 9,207,034 | B2 * | 12/2015 | Larson, Jr. | F41A 21/36 |
| 9,228,789 | B1 * | 1/2016 | Oglesby | F41A 21/36 |
| 9,303,939 | B1 * | 4/2016 | Brinkmeyer | F41A 21/38 |
| 9,310,152 | B1 * | 4/2016 | Poling | F41A 21/36 |
| D783,758 | S * | 4/2017 | Clark | D22/108 |
| D860,368 | S * | 9/2019 | Hargis | D22/108 |
| 2008/0083321 | A1 * | 4/2008 | Dueck | F41A 21/36 89/14.3 |

(Continued)

FOREIGN PATENT DOCUMENTS

| | | | | |
|---|---|---|---|---|
| FR | 815441 A * | 7/1937 | | F41A 21/36 |
| FR | 815441 A | 7/1937 | | |
| GB | 479107 | 1/1938 | | |

*Primary Examiner* — John Cooper
(74) *Attorney, Agent, or Firm* — Eric B. Fugett; Mark A. Pitchford; Pitchford Fugett, PLLC

(57) ABSTRACT

A muzzle brake (i.e., muzzle brake, suppressor, or compensator) directs air through ports in a top of the muzzle brake. Each pair of ports, left and right, has a corresponding baffle to which they are adjacent and form a recess in the rear face of. Each port is between 15 and 30 degrees from top center, and each port angles forward between 15 and 30 degrees. Each port is threaded such that a user may shut the port off with a set screw. Each baffle has a top tooth and a bottom tooth which direct gases from the muzzle of the firearm laterally and into the pair of ports associated with the baffle. The brake may also have lateral vents to disperse the excess gases received from the muzzle.

19 Claims, 11 Drawing Sheets

(56) References Cited

U.S. PATENT DOCUMENTS

| | | | | |
|---|---|---|---|---|
| 2016/0169606 | A1* | 6/2016 | Joplin | F41A 21/36<br>42/1.06 |
| 2017/0343311 | A1* | 11/2017 | Deros | F41A 21/34 |
| 2018/0017352 | A1* | 1/2018 | Addis | F41A 21/325 |
| 2019/0086174 | A1* | 3/2019 | Scharer | F41A 21/36 |

* cited by examiner

TUNABLE MUZZLE BRAKE FOR A FIREARM

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a continuation application of U.S. Non-Provisional application Ser. No. 16/533,730, entitled "TUNABLE MUZZLE BRAKE FOR A FIREARM" filed on Aug. 6, 2019, which claims priority to U.S. Provisional Patent Application Ser. No. 62/726,361 entitled "TUNABLE MUZZLE BRAKE FOR A FIREARM" filed on Sep. 20, 2018, the entirety of each of which is hereby incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to firearms accessories. More particularly, this invention pertains to muzzle brakes for mounting on the muzzle of a firearm (including airguns).

Muzzle brakes or recoil compensators ("compensators") are devices connected to the muzzle of a firearm that direct propellant gases to counter recoil, hide muzzle flash, reduce noise, and/or reduce muzzle rise during operation. Brakes have been used in various forms on rifles, pistols and revolvers. Generally, brakes use a variety of slots, vents, holes, and/or baffles to redirect and control the burst of gases that follows the departure of a projectile from the muzzle of a firearm to affect the movement of the firearm immediately after the projectile leaves the muzzle. For durability and ease of machining, the slots, vents, and/or holes in traditional brakes are static and thus the direction(s) in which propellant gases are vented from such compensators (i.e., brakes) is fixed.

BRIEF SUMMARY OF THE INVENTION

Aspects of the present invention provide a muzzle brake (i.e., muzzle brake, suppressor, or compensator) that directs air through ports in a top of the muzzle brake. Each pair of ports, left and right, has a corresponding baffle to which they are adjacent and form a recess in the rear face of. Each port is between 15 and 30 degrees from top center, and each port angles forward between 15 and 30 degrees. Each port is threaded such that a user may shut the port off with a set screw. Each baffle has a top tooth and a bottom tooth which direct gases from the muzzle of the firearm laterally and into the pair of ports associated with the baffle. The brake may also have lateral vents to disperse the excess gases received from the muzzle.

In one embodiment, a tunable muzzle brake for a firearm allows a user to select which of one or more directions propellant gases are vented during discharge of a firearm (e.g., airgun, rifle, or pistol) and further to select the relative amounts of propellant gases vented in each direction by opening or closing one or more closable vents or ports defined through the body of the muzzle brake. As such, a tunable muzzle brake of the present disclosure can help a user better control and directionally tune the recoil experienced upon discharge of a round of a ammunition from a firearm to which the muzzle brake is attached.

In one embodiment, muzzle brake extends along a longitudinal axis. The muzzle brake includes a brake body, baffle, and a port. The brake body extends longitudinally. The brake body is configured to engage a muzzle of a firearm such that the longitudinal axis of the brake body is generally coaxial with a bore axis of the firearm. The brake body is configured to engage the muzzle at a rear end of the brake body when the muzzle brake is installed on the firearm. The baffle extends inwardly from the brake body toward the longitudinal axis. The port is longitudinally between the rear end of the brake body and the baffle. The port extends from an interior space (e.g., a main bore axis through which a projectile of the firearm passes) of the brake through the brake body.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
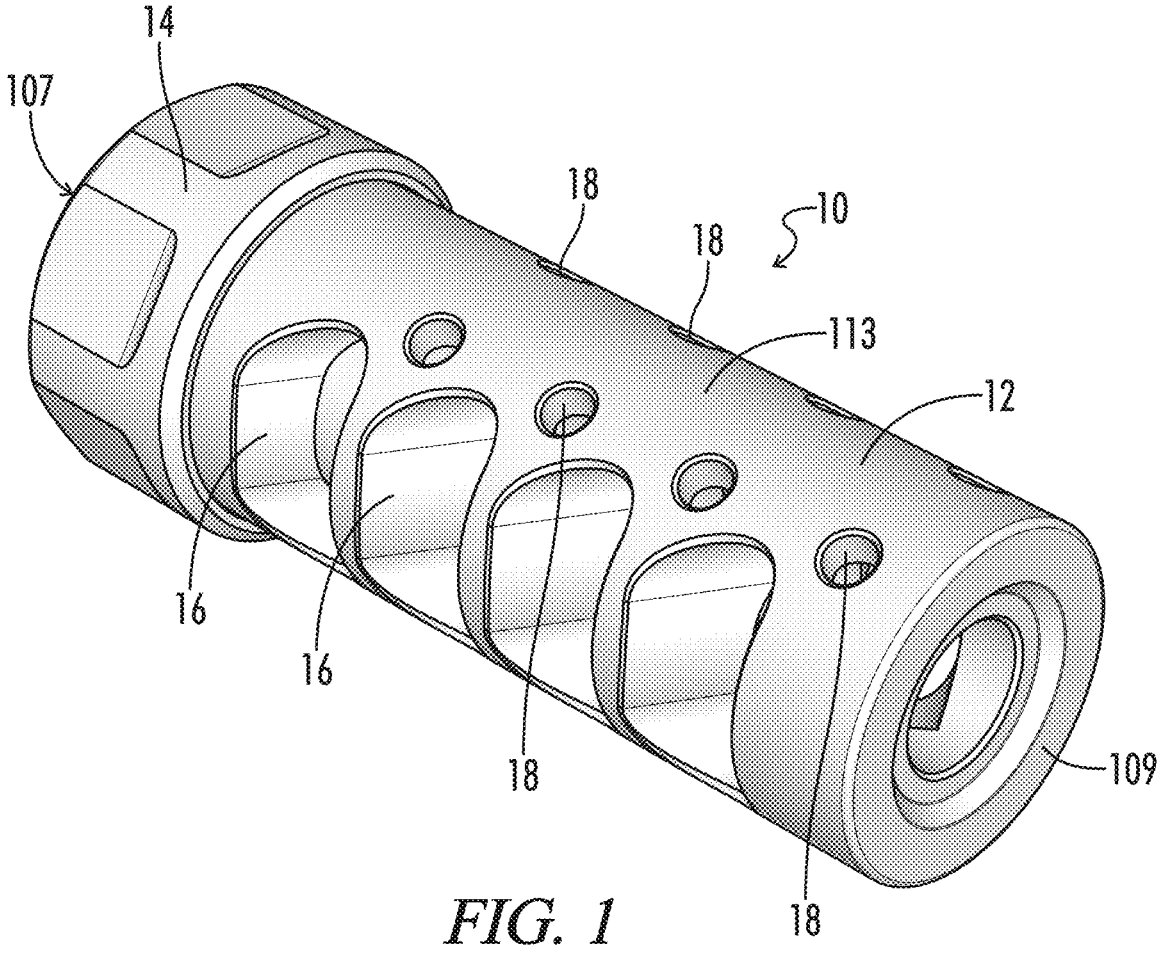
FIG. 1 shows an isometric view of a tunable muzzle brake for a firearm.
Figure 2:
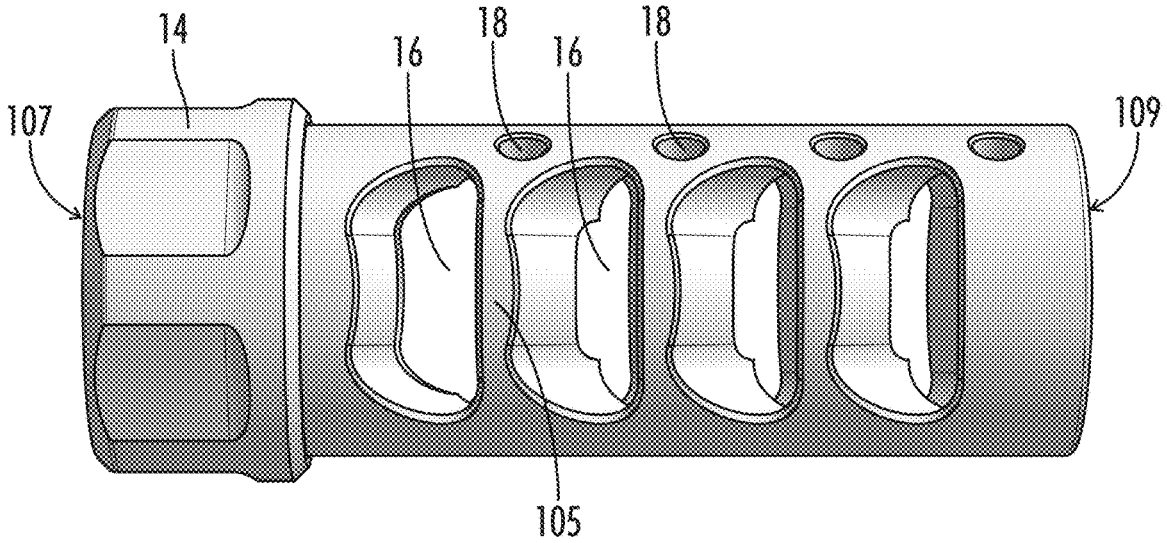
FIG. 2 shows a right side perspective view of the muzzle brake of FIG. 1.
Figure 3:
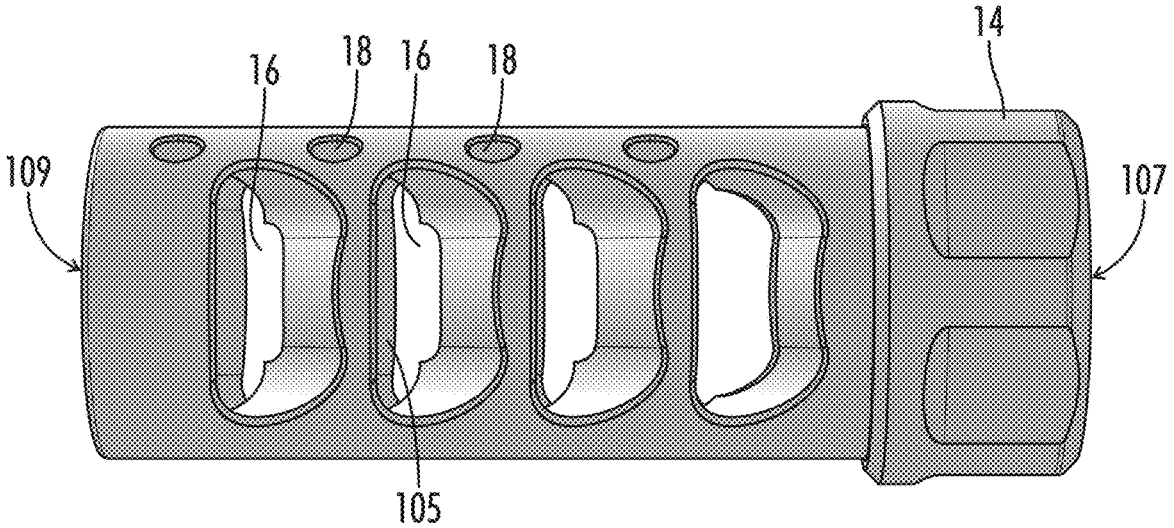
FIG. 3 shows a left side perspective view of the muzzle brake of FIG. 1.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. The upright position of a muzzle brake is the position it would be in properly attached to a firearm muzzle when the firearm is being held by a shooter in a generally level or horizontal shooting position (e.g., aimed at a target of slightly less elevation than the muzzle of the firearm). A rear end of the muzzle brake engages the barrel of the firearm, and a front end of the muzzle brake is opposite the rear end of the muzzle brake. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 4:
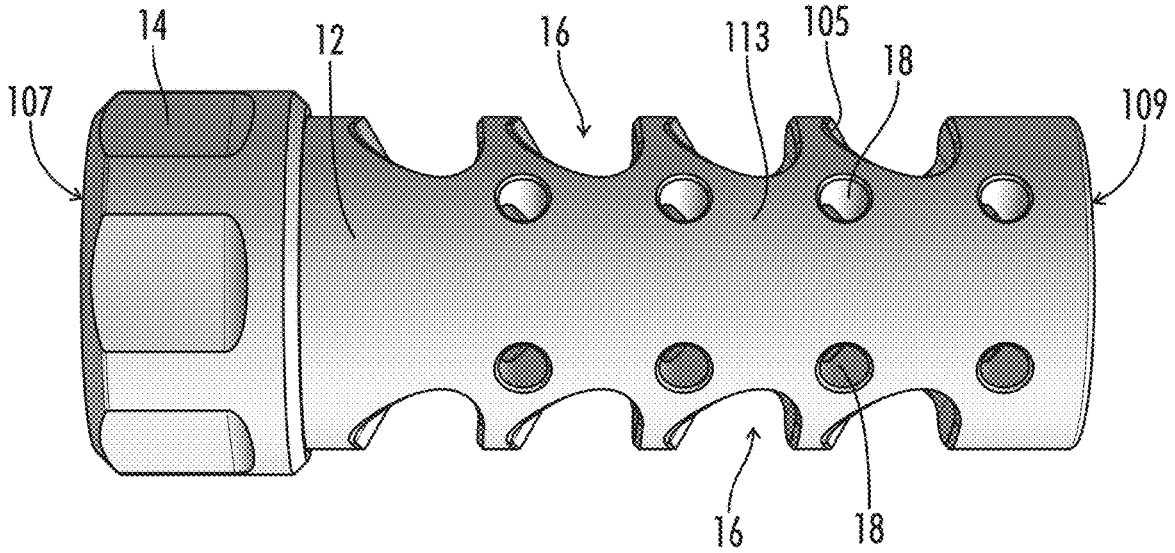
FIG. 4 shows a top perspective view of the muzzle brake of FIG. 1.
Figure 5:
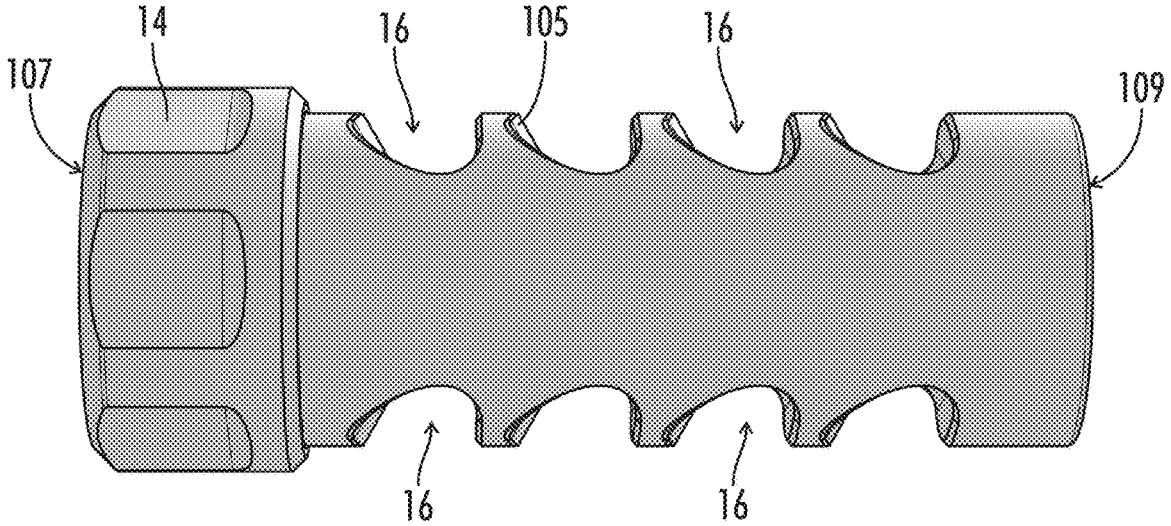
FIG. 5 shows a bottom perspective view of the muzzle brake of FIG. 1.
Figure 6:
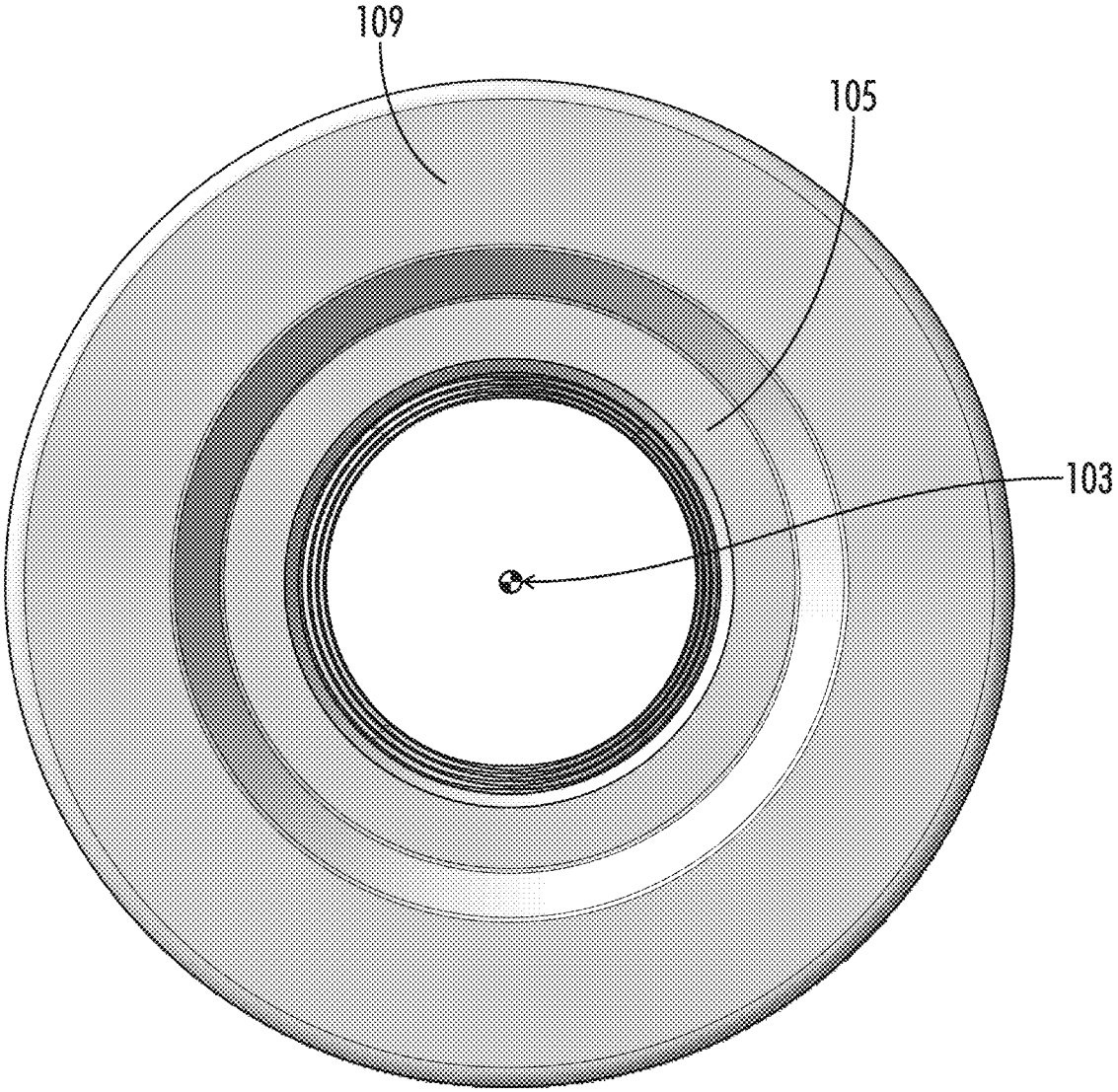
FIG. 6 shows a front perspective view of the muzzle brake of FIG. 1 centered about a longitudinal axis of the muzzle brake.
Figure 7:
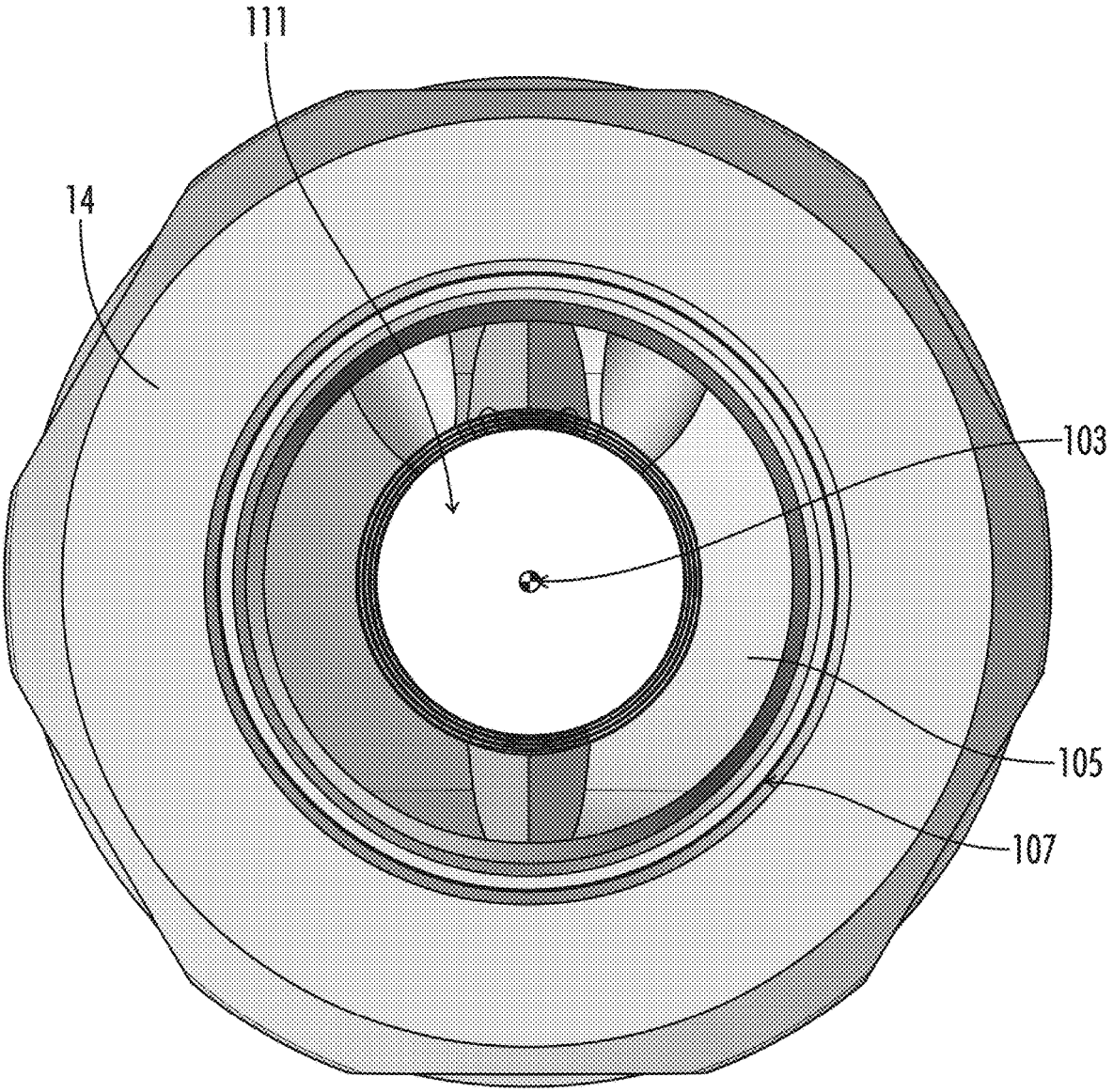
FIG. 7 shows a rear perspective view of the muzzle brake of FIG. 1 centered about a longitudinal axis of the muzzle brake.
Figure 8:
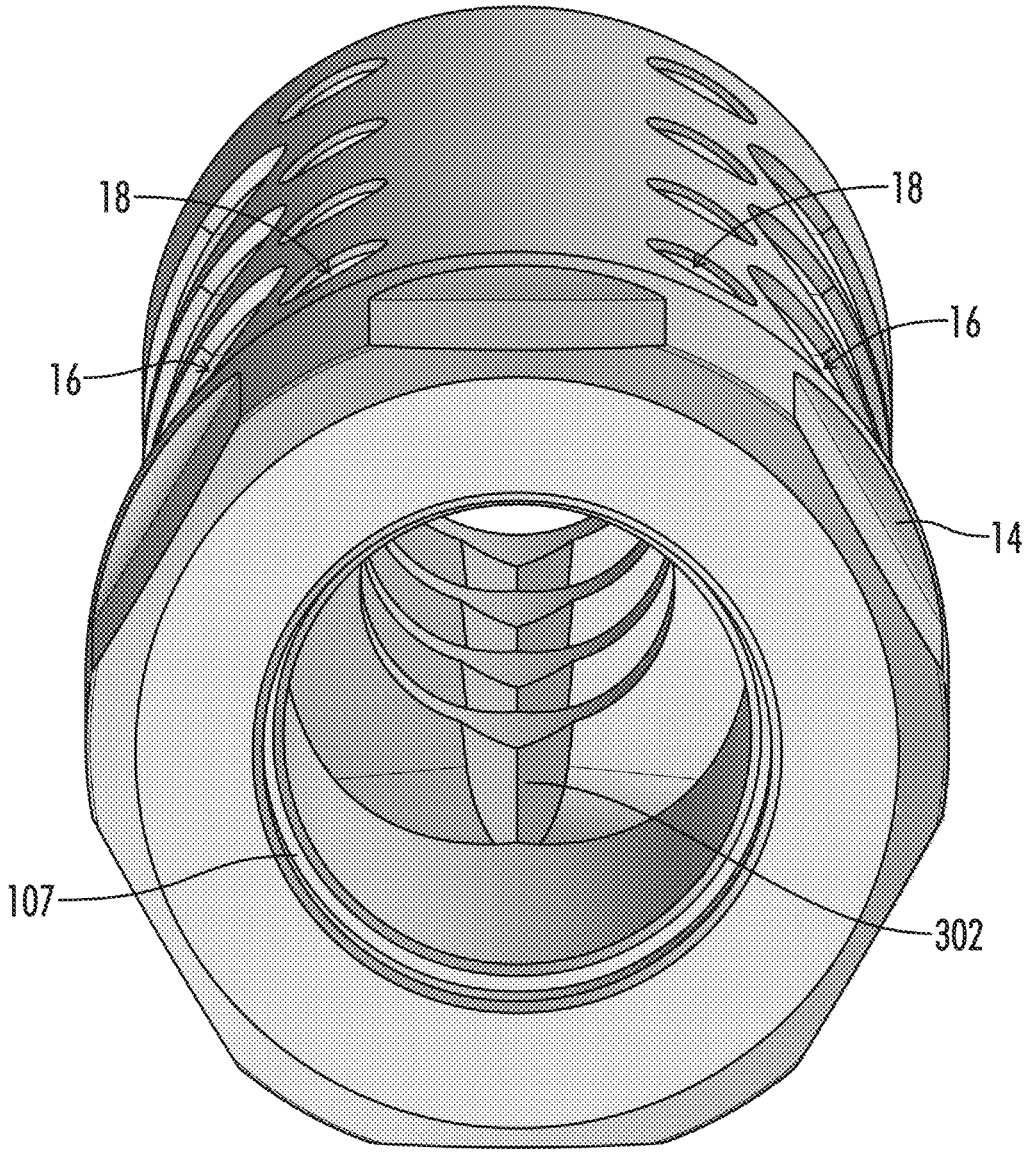
FIG. 8 is a rear elevation view of the muzzle brake of FIG. 1 looking downward to view the top exterior surface and the bottom interior surface of the muzzle brake.
Figure 9:
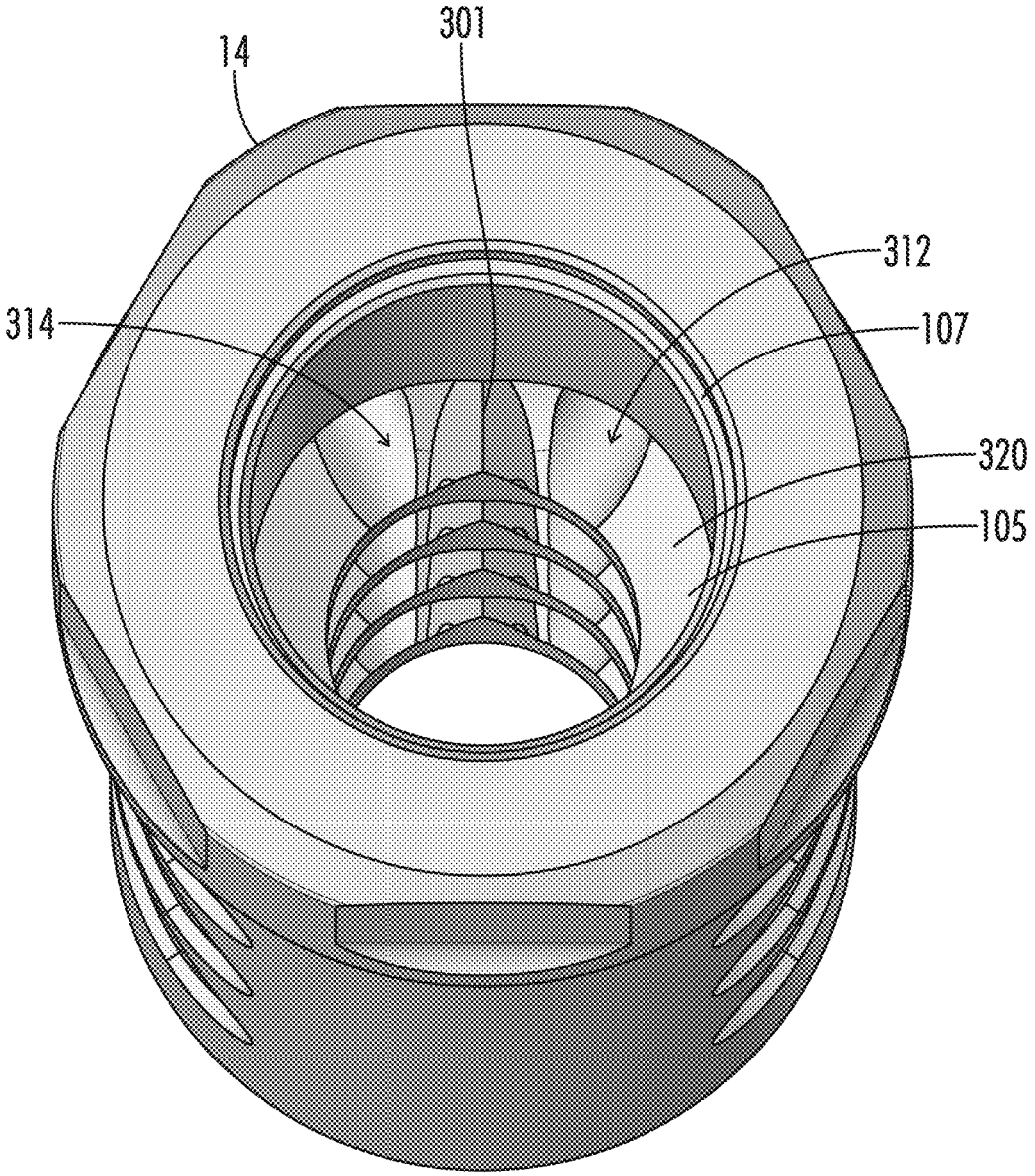
FIG. 9 is a rear depressed view of the muzzle brake of FIG. 1 looking upward to view the bottom exterior surface and the top interior surface of the muzzle brake.

Referring to FIGS. 1-13, in one embodiment, a tunable muzzle brake 10 includes a brake body 12. The brake body 12 includes a threaded portion configured to engage a barrel of firearm (i.e., the muzzle of the firearm). In one embodiment, the muzzle brake 10 includes a jam nut 14 configured to thread onto a portion of the rear end of the brake body 12 in the manner described in more detail in U.S. Pat. No. 9,709,355, the contents of which are hereby incorporated by reference in their entirety. In one embodiment, brake body 12 includes a plurality of lateral side vents 16 defined therein. The plurality of vents 16 can be formed in two rows extending along the length of each of the left and right side of the brake body 12 as best shown in FIG. 4.

In operation, the brake body 12 attaches to the barrel of a firearm (i.e., the muzzle) in a predetermined orientation (i.e., upright), and the jam nut 14 is tightened down against the end of the barrel in order to ensure that the brake body 12 maintains the predetermined orientation with respect to the firearm during use (i.e., discharge of the firearm).

Figure 10:
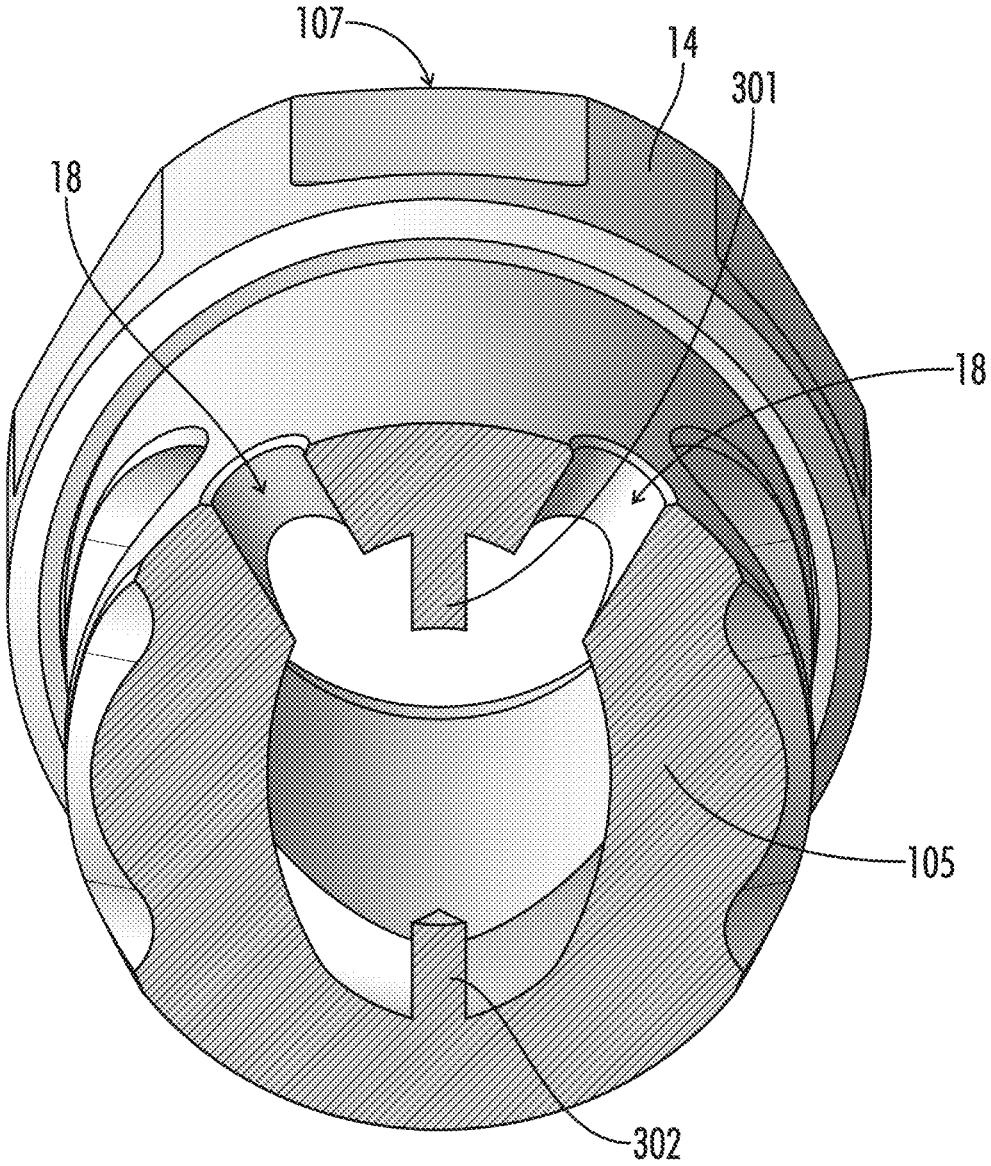
FIG. 10 is an elevated front cutaway view of the muzzle brake of FIG. 1 showing the angle of the ports formed in the brake body relative to the longitudinal axis of the brake.
Figure 11:
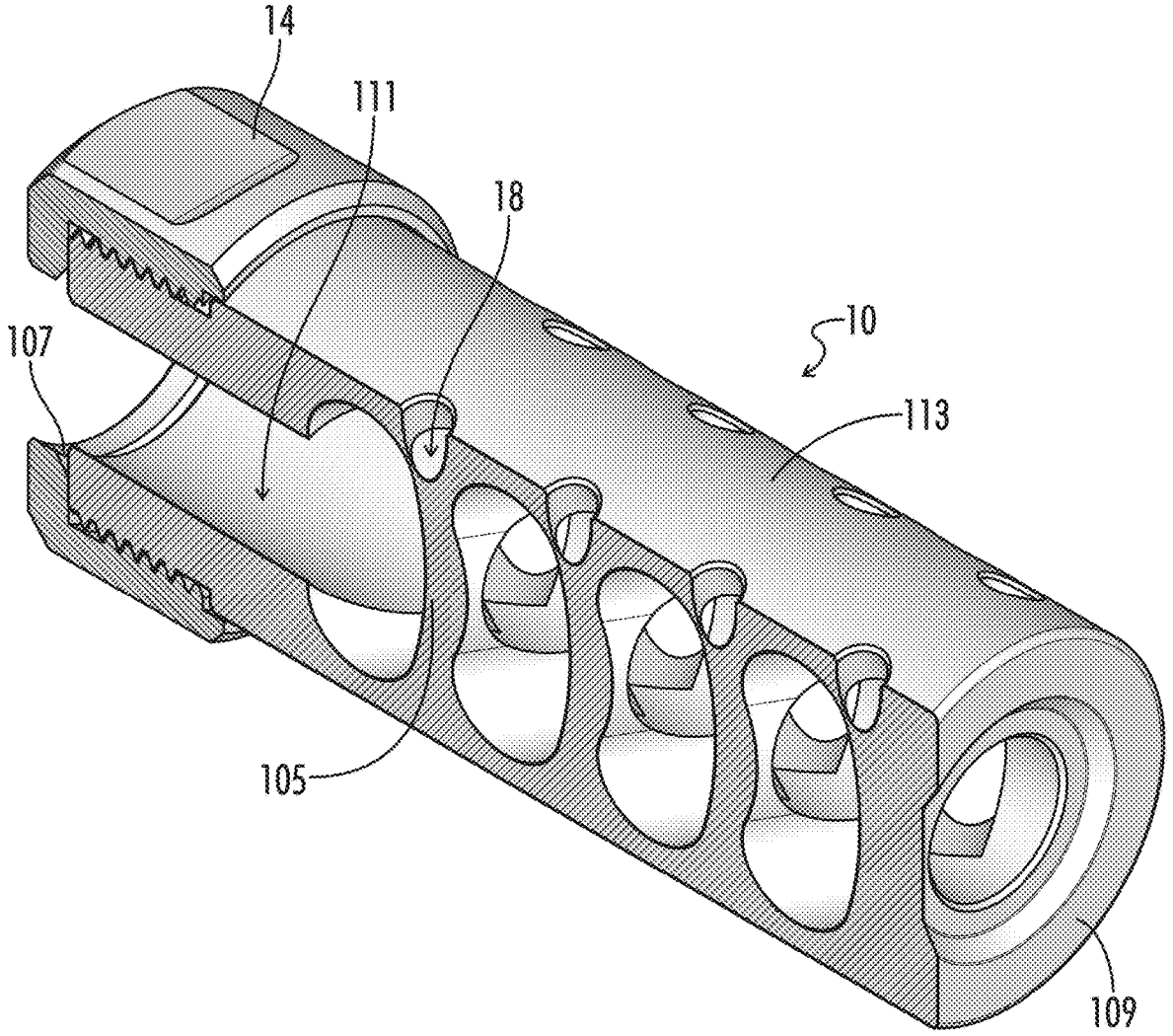
FIG. 11 is a cutaway isometric view of the muzzle brake of FIG. 1.
Figure 12:
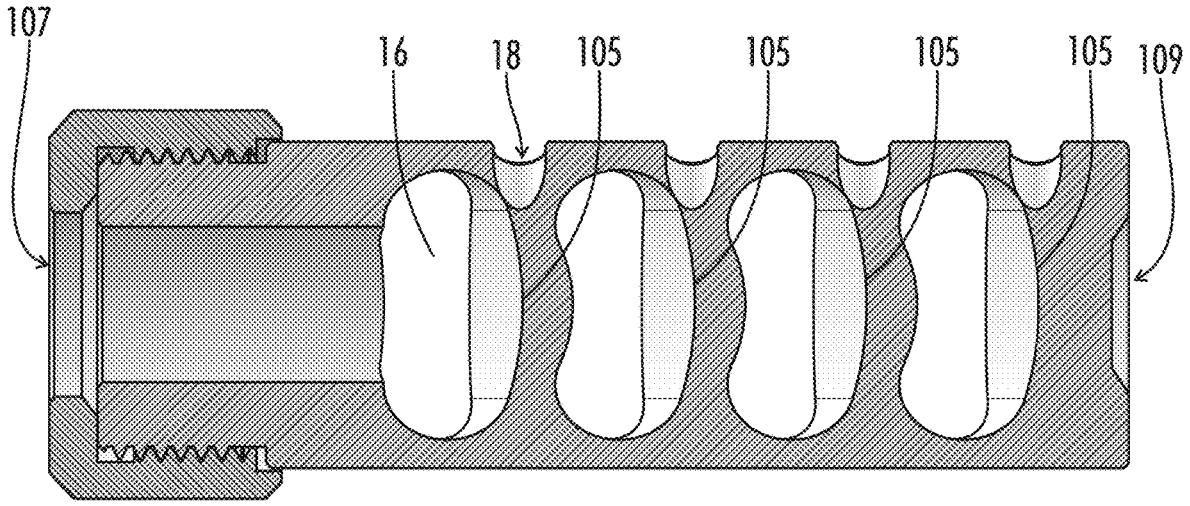
FIG. 12 is side cutaway view of the muzzle brake of FIG. 1.
Figure 13:
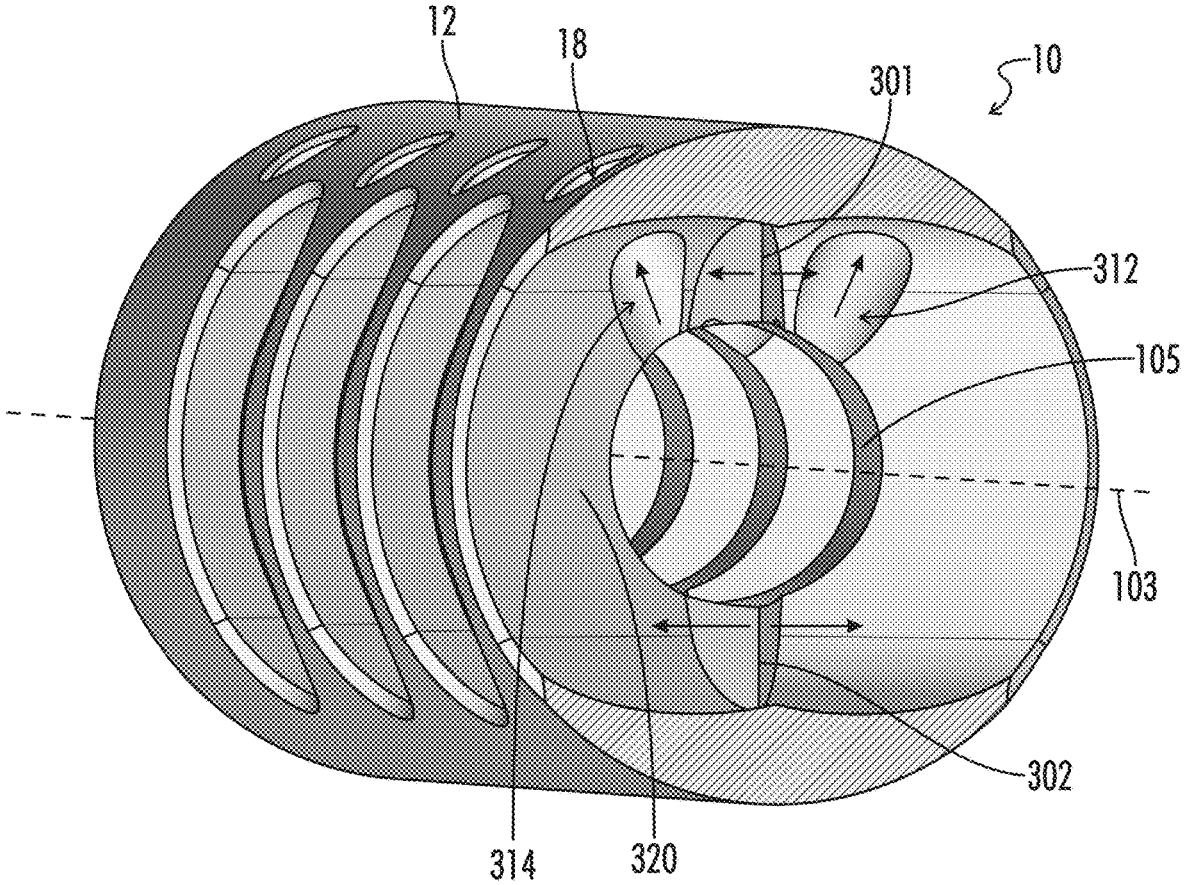
FIG. 13 is a rear isometric cutaway view of the muzzle brake of FIG. 1.

In one embodiment, brake body 12 also includes a plurality of holes or ports 18 defined therethrough, which, like vents 16, extend along the length of brake body 12 in columns or rows (e.g., a left column and a right column) from a portion of the forward end of the brake toward the rearward end of the brake 10. In one embodiment, the ports 18 are defined in two rows through a top portion of the brake body 12, as shown in FIG. 4. In one embodiment, as best shown in FIGS. 10-12, ports 18 are formed in brake body 12 at an angle such that ports 18 extend through brake body 12 radially from an origin located on a longitudinal axis extending through muzzle brake 10.

In one embodiment, the brake 10 includes set screws. The ports 18 can be provided with screw threads (e.g., internal female screw threads, not shown) and be sized and shaped to threadingly receive one of the set screws (e.g., any of the similarly sized set screws) therein. As such, the plurality of screws are receivable in ports 18 to seal or selectively close ports 18. In use, a user may selectively seal or close one or more ports 18 in brake body 12 by threading a screw into such port or ports. By sealing or closing one or more ports 18 in brake body 12, a user may selectably control the direction(s) in which the brake 10 vents propellant gases, as well as the volume or magnitude of propellant gases vented in each direction through any open ports 18 or vents 16, during discharge of a round of ammunition (or projectile in the case of an airgun). This allows a user to directionally control or tune the recoil experienced during shooting of a firearm to which the brake 10 is attached.

For example, by threading screws into each port of the row of ports 18 defined in the upper left side of the brake 10, the user may seal or close off those ports 18 and thereby prevent propellant gases from being vented through them. This will result in a greater volume of propellant gases being vented through the opposite row of ports defined in the upper right side of the brake 10. The greater volume of gas vented through the upper right row of ports 18 will in turn exert greater down and leftward force on the muzzle of an attached firearm than if both rows of ports were open and unobstructed (which would provide equal downward force). Ports 18 may be sealed or closed in any uniform or non-uniform pattern or order that may be desired by a user.

By selectively sealing or closing one or more ports on one or both sides of the brake 10, a user may modulate the direction and volume of propellant gases discharged during firing of a firearm to which the brake is attached in order to directionally tune experienced recoil to account for differences in cartridge pressure and user trigger control, among other factors.

In one embodiment, the muzzle brake 10 extends along a longitudinal. The muzzle brake 10 includes a brake body 12, a baffle 105, and a port 18. The brake body 12 extends longitudinally along the longitudinal. The brake body 12 is configured to engage in muzzle of a firearm such that the longitudinal of the brake body is generally coaxial with a bore axis of the firearm. The bore axis of the firearm is the centerline along which the projectile exiting the muzzle of the firearm travels. The brake body 12 is configured to engage the muzzle at a rear end 107 of the brake body 12 when the muzzle brake 10 is installed on the firearm. A front end 109 of the muzzle brake 10 is longitudinally opposite the rear end 107 of the muzzle brake 10. The brake body 12 defines an interior space 111 through which a projectile from the firearm passes.

The baffle 105 extends inwardly toward the longitudinal from the brake body 12 into the interior space 111 defined by the brake body 12. In one embodiment, the baffle 105 is 1 of a plurality of baffle space longitudinally from one another along the longitudinal axis 103 of the brake 10. In one embodiment, each baffle 105 defines a plane generally perpendicular to the longitudinal axis 103.

In one embodiment, at least one baffle 105 of the plurality of baffles includes a tooth 301 or diverter extending longitudinally rearward from the baffle 105. In one embodiment, the baffle 105 further includes a second tooth 302. In one embodiment, the first tooth 301 is located in a 12 o'clock position, and the second tooth 302 is located in a 6 o'clock position w when the brake 10 is viewed from the rear along the longitudinal axis 103. In one embodiment, the first tooth 301 and the second tooth 302 narrow as they extend rearward from the baffle 105 such that the first tooth 301 and second tooth 302 are configured to direct gases exiting the muzzle of the firearm laterally (e.g, through corresponding vents 116). In one embodiment, a pair of ports 18 correspond to one or more of the baffles 105 of the plurality of baffles. The top tooth 301 is positioned between the left port and the right port of the pair of ports 18. In one embodiment, the left port in the right port each form a recess 314, 312 in a rear face 320 of the corresponding baffle 105.

The port 18 extends through the brake body 12 into the interior space 111 defined by the brake body 12. In one embodiment, port 18 is a generally cylindrical hole through the brake body 12. In one embodiment, the port 18 is closer to the rear end 107 of the brake body 12 where the port 18 enters the interior space 111 of the muzzle brake 10 then where the court penetrates an outer surface 113 of the brake body 12. In one embodiment, the port 18 is at least partially in a top half of the muzzle brake 10, wherein the top half is determined when the brake 10 is in the upright position. In one embodiment, the port 18 extends radially outward from the longitudinal and away from the rear end 107 of the brake 10. The port 18 also extends through the outer surface 113 of the brake body 12 from the interior space 111 of the brake body 12. In one embodiment, the brake includes additional ports between 2 baffles of the longitudinally space plurality of baffles 105. In one embodiment, each port 18 extends along a radius intersecting the longitudinal axis 103. In one embodiment, each port leans forward with respect to the longitudinal axis 103 at between 15 and 45°. In one embodiment, each port 18 is offset from a 12 o'clock position of the brake 10 by between 15 and 45°.

In one embodiment, the muzzle brake 10 further includes a jam nut 14. The jam nut 14 is configured to threadedly engage the brake body 12 adjacent the rear end 107 of the brake body 12. The jam nut 14 is configured to contact an end of the barrel forming the muzzle of the firearm when the muzzle brake 10 is attached to the firearm. As used herein, firearm may mean a black powder weapon, a smoothbore shotgun, a rifled shotgun, a rifle, a pistol, and/or an airgun.

In one embodiment, the muzzle brake 10 further includes a vent 16 extending laterally (i.e., at least partially horizontally when in the upright position) from the longitudinal axis 103 through the outside surface 113 of the brake body 12. In one embodiment, the vent 16 is a first vent extending left from the longitudinal axis 103 when the muzzle brake 10 is viewed from the rear along the longitudinal axis 103, and the brake 10 is in the upright position. In one embodiment, the brake 10 further includes a second vent corresponding to (e.g., mirroring) the first vent extending right from the longitudinal axis 103 when the muzzle brake 10 is viewed from the rear along the longitudinal axis 103 and the brake is in the upright position. In one embodiment, the first vent and the second vent 16 or longitudinally between the rear end 107 of the brake 10 and the baffle 105.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful TUNABLE MUZZLE BRAKE FOR A FIREAM it is not intended that such references be construed as limitations upon the scope of this invention except as set forth in the following claims

What is claimed is:

1. A muzzle brake extending along a longitudinal axis, said muzzle brake comprising:

a brake body extending longitudinally, said brake body configured to engage a muzzle of a firearm such that the longitudinal axis of the brake body is generally coaxial with a bore axis of the firearm, wherein the brake body is configured to engage the muzzle at a rear end of the brake body when the muzzle brake is installed on the firearm;

a baffle extending inwardly from the brake body toward the longitudinal axis;

a port longitudinally between the rear end of the brake body and the baffle, the port extending radially outwardly through the brake body from an interior space of the brake body, the interior space extending along the longitudinal axis; and a tooth extending longitudinally rearwardly from the baffle, the tooth being configured to direct a gas exiting the muzzle of the firearm into the port.

2. The muzzle brake of claim 1, wherein the port is a generally cylindrical hole through the brake body.

3. The muzzle brake of claim 1, wherein the port is closer to the rear end of the brake body where the port enters the interior space than where the port penetrates an outer surface of the brake body.

4. The muzzle brake of claim 1, wherein the port is, at least partially, in a top half of the muzzle brake.

5. The muzzle brake of claim 1, wherein the port extends away from the rear end of the brake.

6. The muzzle brake of claim 1, further comprising a jam nut threadedly engaging the brake body adjacent the rear end of the brake body, wherein said jam nut is configured to contact an end of a barrel forming the muzzle of the firearm when the muzzle brake is attached to the firearm.

7. The muzzle brake of claim 1, further comprising a vent extending laterally from the longitudinal axis through the brake body when the muzzle brake is installed on the firearm.

8. The muzzle brake of claim 1, wherein:

the muzzle brake further comprises a vent extending laterally from the longitudinal axis through the brake body when the muzzle brake is installed on the firearm;

the vent is a first vent extending left from the longitudinal axis when the muzzle brake is viewed from the rear end along the longitudinal axis and the muzzle brake is in an upright position of the muzzle brake; and the muzzle brake further comprises a second vent corresponding to the first vent extending right from the longitudinal axis when the muzzle brake is viewed from the rear end along the longitudinal axis and the muzzle brake is in the upright position.

9. The muzzle brake of claim 1, wherein:

the muzzle brake further comprises a vent extending laterally from the longitudinal axis through the brake body when the muzzle brake is installed on the firearm;

the vent is a first vent extending left from the longitudinal axis when the muzzle brake is viewed from the rear end along the longitudinal axis and the muzzle brake is in an upright position of the muzzle brake;

the muzzle brake further comprises a second vent corresponding to the first vent extending right from the longitudinal axis when the muzzle brake is viewed from the rear end along the longitudinal axis and the muzzle brake is in the upright position; and the first vent and the second vent are longitudinally between the rear end of the muzzle brake and the baffle.

10. The muzzle brake of claim 1, wherein the baffle is one of a plurality of baffles spaced longitudinally from one another along the longitudinal axis of the muzzle brake.

11. The muzzle brake of claim 10, wherein:

the baffle is one of a plurality of baffles spaced longitudinally from one another along the longitudinal axis of the muzzle brake;

the port is a first port; and the muzzle brake further comprises a second port longitudinally between two baffles of the plurality of baffles.

12. The muzzle brake of claim 1, wherein:

the baffle is one of a plurality of baffles spaced longitudinally from one another along the longitudinal axis of the muzzle brake; and each baffle defines a plane generally perpendicular to the longitudinal axis.

13. The muzzle brake of claim 1, wherein the tooth extends rearwardly from the baffle beyond the port.

14. The muzzle brake of claim 1, wherein:

the tooth is a first tooth; and the baffle further comprises a second tooth extending longitudinally rearward from the baffle.

15. The muzzle brake of claim 1, wherein:

the tooth is a first tooth;

the first tooth is located in a 12 o'clock position when the muzzle brake is viewed from the rear end along the longitudinal axis;

the baffle further comprises a second tooth extending longitudinally rearward from the baffle; and the second tooth is located in a 6 o'clock position when the muzzle brake is viewed from the rear end along the longitudinal axis.

16. The muzzle brake of claim 1, wherein:

the tooth is a first tooth;

the first tooth is located in a 12 o'clock position when the muzzle brake is viewed from the rear end along the longitudinal axis; and the first tooth narrows as the first tooth extends rearward from the baffle such that the first tooth is configured to direct a gas exiting the muzzle of the firearm laterally.

17. The muzzle brake of claim 1, wherein:

the tooth is a first tooth;

the first tooth is located in a 12 o'clock position when the muzzle brake is viewed from the rear end along the longitudinal axis;

the baffle further comprises a second tooth extending longitudinally rearward from the baffle;

the second tooth is located in a 6 o'clock position when the muzzle brake is viewed from the rear end along the longitudinal axis; and the first tooth and the second tooth narrow as each tooth extends longitudinally rearward from the baffle such that the first tooth is configured to direct a gas exiting the muzzle of the firearm laterally.

18. The muzzle brake of claim 1, wherein:

the port is a first port;

the muzzle brake further comprises a second port corresponding to the first port;

the second port is between the rear end of the brake body and the baffle;

the first port is on a left half of the muzzle brake and the second port is on a right half of the muzzle brake when the muzzle brake is viewed from the rear end along the longitudinal axis and the muzzle brake in an upright position of the muzzle brake;

the first port and the second port have threads; and the muzzle brake further comprises a plurality of set screws configured to engage the threads of at least one of the first port or the second port and block off said port.

19. The muzzle brake of claim 1, wherein:

the port is a first port;

the muzzle brake further comprises a second port corresponding to the first port;

the second port is between the rear end of the brake body and the baffle;

the first port is on a left half of the muzzle brake and the second port is on a right half of the muzzle brake when the muzzle brake is viewed from the rear end along the longitudinal axis and the muzzle brake in an upright position of the muzzle brake;

the tooth is a first tooth;

the first tooth is located in a 12 o'clock position when the muzzle brake is viewed from the rear end along the longitudinal axis;

the baffle further comprises a second tooth extending longitudinally rearward from the baffle;

the second tooth is located in a 6 o'clock position when the muzzle brake is viewed from the rear end along the longitudinal axis;

the first tooth and the second tooth narrow as each tooth extends rearward from the baffle such that the first tooth is configured to direct a gas exiting the muzzle of the firearm laterally; and the first port and the second port each form a recess in a rear face of the baffle as each of the first port and the second port extend through the brake body into an interior space of the muzzle brake.

* * * * *